US007746282B2

(12) United States Patent
Lin et al.

(10) Patent No.: US 7,746,282 B2
(45) Date of Patent: Jun. 29, 2010

(54) COMPACT TOP-LOADED, TUNABLE FRACTAL ANTENNA SYSTEMS FOR EFFICIENT ULTRABROADBAND AIRCRAFT OPERATION

(75) Inventors: Zhen Biao Lin, West Hills, CA (US); Jack J. Q. Lin, Northridge, CA (US); Seymour Robin, Woodland Hills, CA (US)

(73) Assignee: Sensor Systems, Inc., Chatsworth, CA (US)

( * ) Notice: Subject to any disclaimer, the term of this patent is extended or adjusted under 35 U.S.C. 154(b) by 162 days.

(21) Appl. No.: 12/154,209

(22) Filed: May 20, 2008

(65) Prior Publication Data

US 2009/0289871 A1 Nov. 26, 2009

(51) Int. Cl.
*H01Q 1/50* (2006.01)
*H01Q 9/40* (2006.01)

(52) U.S. Cl. ..... 343/745; 343/705; 343/752; 343/861; 343/872

(58) Field of Classification Search ..... 343/700 MS, 343/752, 860, 705, 745, 861, 872
See application file for complete search history.

(56) References Cited

U.S. PATENT DOCUMENTS

| | | | | |
|---|---|---|---|---|
| 5,673,055 | A | 9/1997 | Hansen | 343/752 |
| 6,054,964 | A | 4/2000 | Hansen et al. | 343/752 |
| 6,140,975 | A * | 10/2000 | Cohen | 343/846 |
| 6,147,651 | A | 11/2000 | Yamazaki et al. | 343/702 |
| 6,300,914 | B1 | 10/2001 | Yang | 343/741 |
| 6,476,766 | B1 | 11/2002 | Cohen | 343/700 |
| 6,809,687 | B2 | 10/2004 | Yuanzhu | 343/700 |
| 6,809,692 | B2 * | 10/2004 | Puente Baliarda et al. | 343/713 |
| 6,870,514 | B2 | 3/2005 | Simpson | 343/846 |
| 6,876,337 | B2 | 4/2005 | Larry | 343/818 |
| 6,885,264 | B1 | 4/2005 | Vincent et al. | 333/204 |
| 7,019,695 | B2 | 3/2006 | Cohen | 343/700 |
| 7,064,725 | B2 | 6/2006 | Shtrikman et al. | 343/770 |
| 7,177,131 | B2 | 1/2007 | Mariskainen et al. | 343/702 |
| 7,215,290 | B2 | 5/2007 | Cohen | 343/702 |
| 7,248,223 | B2 | 7/2007 | Habib et al. | 343/700 |

OTHER PUBLICATIONS

Felber, Philip, "Fractal Antennas", Illinois Institute of Technology, ECE576 Project Study, pp. 1-15, Dec. 12, 2000.

(Continued)

*Primary Examiner*—Michael C Wimer
(74) *Attorney, Agent, or Firm*—Koppel, Patrick, Heybl & Dawson

(57) ABSTRACT

Compact top-loaded, fractal monopole antenna system embodiments are provided for multi-band airborne operation over ultrabroadband ranges (e.g., 30 to 2000 MHz). These multi-band embodiments are self-contained, aerodynamic and compact (e.g., blade height less than 9.5 inches) and are power efficient with a low return loss (e.g., less than −7 dB). System embodiments include a set of impedance-matching circuits configured to substantially match an antenna impedance to a predetermined system impedance over a set of predetermined frequency bands. In an embodiment, at least one impedance-matching circuit includes a chain of selectable air-core inductors which are novelly arranged to improve radiation efficiency and prevent damage to support substrates. In an embodiment, a lowest-frequency one of the impedance-matching circuits is configured to process signals having a maximum wavelength $\lambda_{max}$ wherein a fractal member is configured with a length that does not exceed $\lambda_{max}/40$. System embodiments are configured to respond to a variety of existing radio systems that send commands via different encoding formats.

24 Claims, 9 Drawing Sheets

OTHER PUBLICATIONS

McDonald, Kirk T., "Small Fractal Antennas", Joseph Henry Laboratories, Princeton University, Princeton, N. J., pp. 1-9, Dec. 22, 2003.

Vernon, Tom, "Fractal Antennas Offer Benefits", Radio World, 2 pages, Sep. 1, 1999.

Cohne, Nathan, "Fractal's New Era in Military Antenna Design", Defense Electronics, pp. 5 pages, ssAug. 2005.

Gonzalez-Arbesu, J. M., "Are Prefractal Monopoles Optimum Minature Antennas?", 2003 IEEE AP-S/URSI, Columbus, Ohio, pp. 1-21, Jun. 1, 2003.

Puente-Baliarda, "On the Behavior of the Sierpinski Multiband Fractal Antenna", IEEE Transactions on Antennas and Propagation, vol. 46, No. 4, Apr. 1998, pp. 517-524.

* cited by examiner

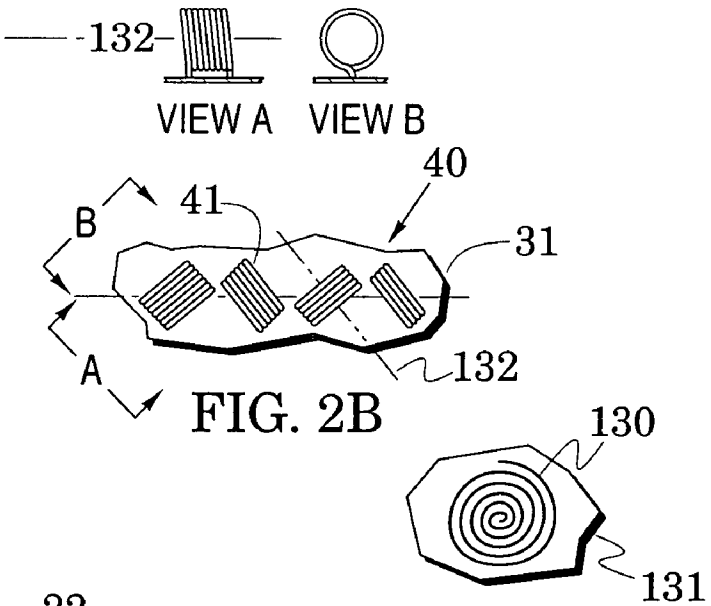
FIG. 2B
FIG. 2C
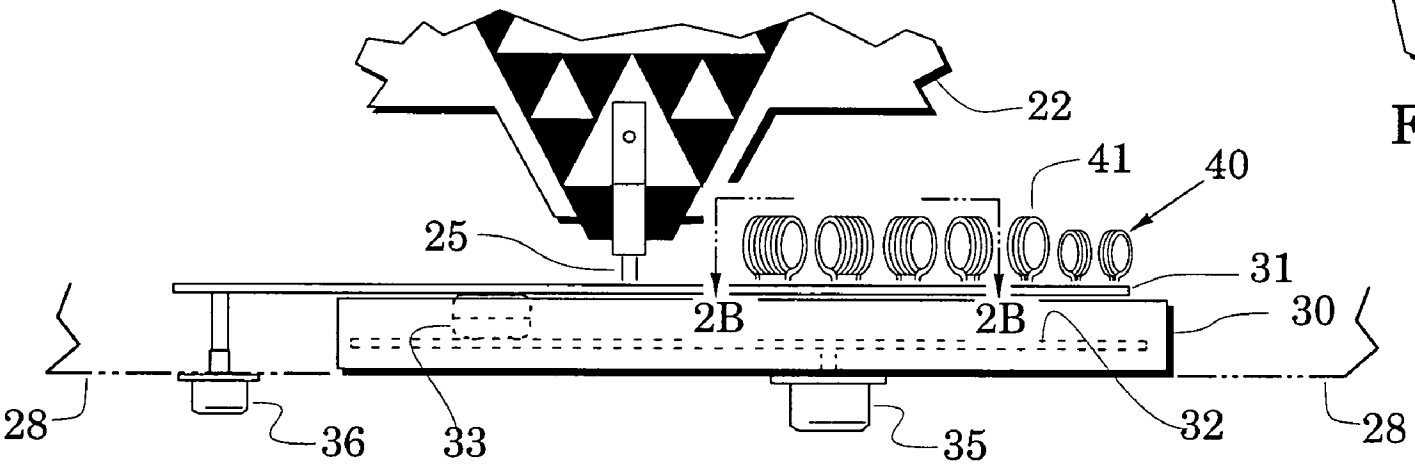
FIG. 2A

COMPACT TOP-LOADED, TUNABLE FRACTAL ANTENNA SYSTEMS FOR EFFICIENT ULTRABROADBAND AIRCRAFT OPERATION

BACKGROUND OF THE INVENTION

1. Field of the Invention

The present invention relates generally to monopole antennas.

2. Description of the Related Art

Military and commercial airborne communication systems have need for exchange of a variety of communication signals (e.g., voice, data, imagery and video) over an extensive ultrabroadband range of signal frequencies (e.g., 30-2000 MHz). Providing antennas for these systems presents some difficult design problems. In the absence of other restrictions, a designer might consider conventional antenna structures (e.g., dipole and monopole antennas) whose dimensions are a significant portion (e.g., one-fourth) of those of the expected signal wavelengths. However, these antenna structures must reliably function over long lifetimes in the hostile environment (e.g., vibration and wind pressure) of high-speed aircraft. The latter requirement requires compact antennas whose dimensions are far less than otherwise desired and whose physical shape will not degrade aircraft performance. Finding ultrabroadband antenna system solutions to these conflicting requirements continues to be a significant challenge.

BRIEF SUMMARY OF THE INVENTION

The present disclosure is generally directed to airborne ultrabroadband tunable antennas. The drawings and the following description provide an enabling disclosure and the appended claims particularly point out and distinctly claim disclosed subject matter and equivalents thereof.

BRIEF DESCRIPTION OF THE DRAWINGS

FIG. 2A is an enlarged view of an electronics housing in the system of FIGS. 1A and 1B;

FIG. 2B is a view along a plane 2B-2B in FIG. 2A;

FIG. 2C illustrates a conventional alternative to the structure of FIG. 2B;

DETAILED DESCRIPTION OF THE INVENTION

Various modern communications systems (e.g., Joint Tactical Radio System (JTRS)) require airborne tunable antenna systems that are capable of multi-band operation over an ultrabroadband range (e.g., 30-2000 MHz) with a single radiator. These system demands must be met in the environment of high-speed aircraft which places severe restrictions on the design of externally-mounted antennas. Because airborne antennas must be physically rugged and compact, their physical length must be severely limited which makes it difficult to obtain favorable antenna parameters (e.g., radiation efficiency and gain). Requiring these antennas to also operate efficiently over an ultrabroadband range further increases the conceptual task.

However, FIGS. 1-11 illustrate self-contained antenna system embodiments which provide multi-band capability coupled with a software-defined radio frequency (RF) tuning architecture. These top-loaded, fractal monopole antenna system embodiments are self-contained and compact (e.g., blade height less than 9.5 inches) and yet capable of efficient multi-band operation over ultrabroadband frequency ranges (e.g., 30 to 2000 MHz). The multi-band embodiments can achieve fast channel switching times (e.g., less than 32 microseconds) and are power efficient because of their low return loss (e.g., less than −8 dB). Because it has been found that inductors in impedance matching circuits of these systems can experience energy loss and generate substrate heating when operating in the lower-frequency bands, they are novelly arranged to prevent eddy current losses and provide significant improvement of radiation efficiency.

Figure 1A:
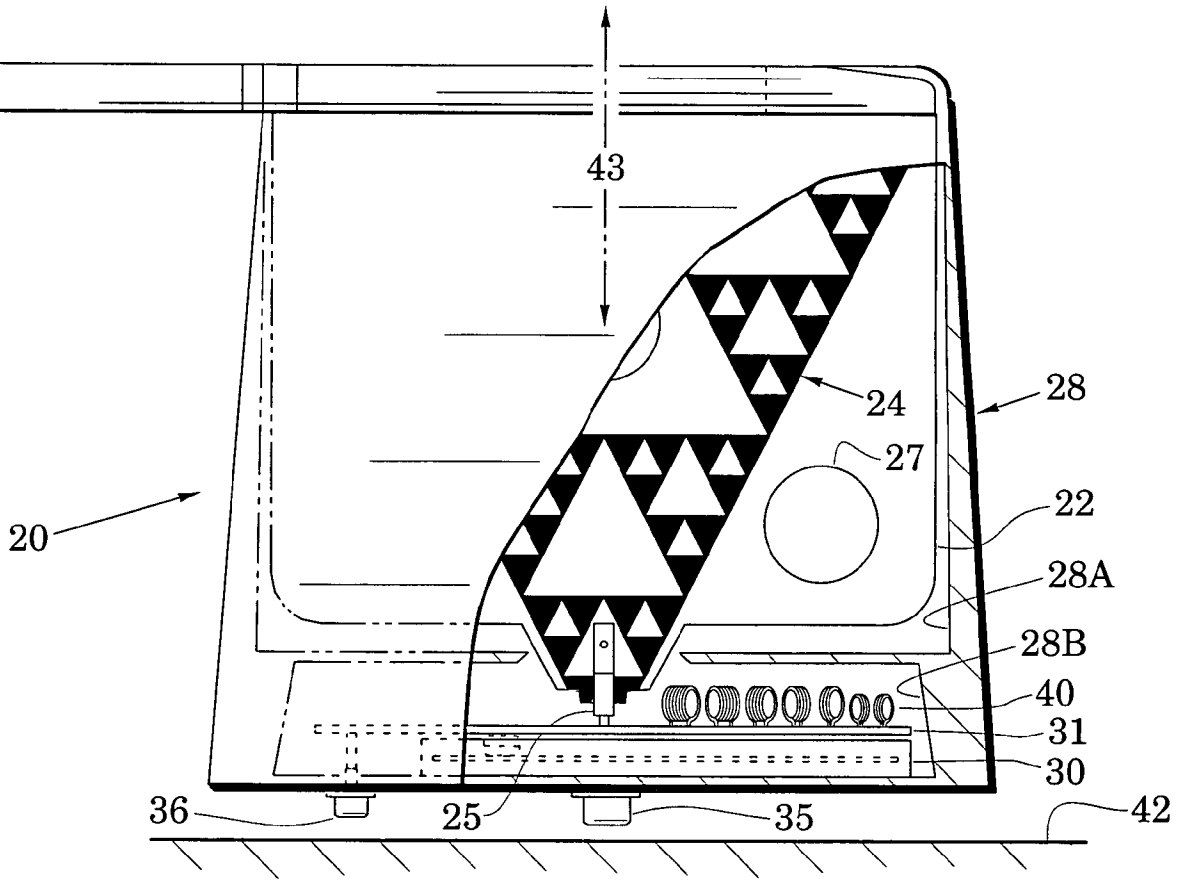
FIGS. 1A and 1B are side and front views of a top-loaded, fractal tunable antenna system embodiment.
Figure 1B:
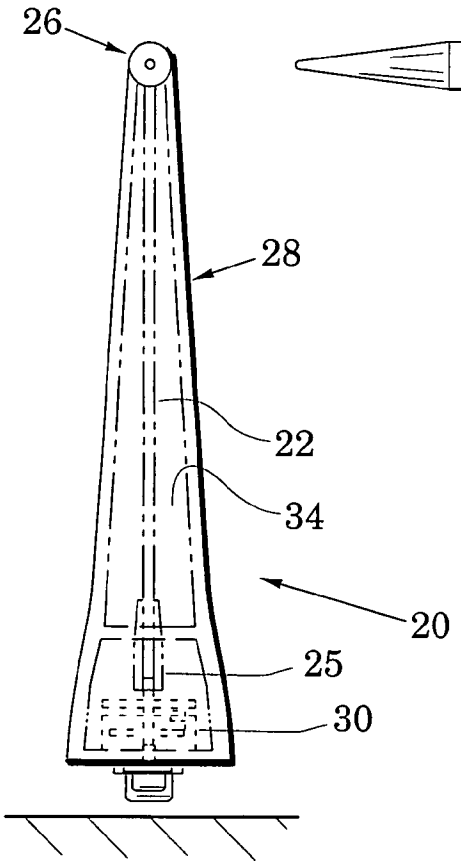

In particular, FIGS. 1A and 1B illustrate a top-loaded, fractal monopole antenna system embodiment 20 which includes a dielectric substrate 22 that carries a conductive fractal member 24. The fractal member is electrically coupled at a first lower end to a coaxial fitting 25 and at a second upper end to a top load 26. It is noted that a dielectric is a structure in which an electric field can be maintained with a minimum loss of power because the structure (e.g., a polymer sheet) has little ability (or an absence of ability) to conduct electricity. The substrate 22, therefore, has minimal effect on operation of the system 20.

As illustrated in FIGS. 1A and 1B, the top load 26 is aerodynamically shaped. In addition to its electrical connection to the fractal member 24, the top load may be mechanically coupled to the substrate 22 and is preferably supported by an aerodynamic blade-shaped radome enclosure 28 (formed, for example, of fiberglass). Internally, this protective enclosure preferably defines first and second cavities 28A and 28B. The first cavity 28A surrounds the substrate 22 and its fractal member 24 and opens at a lower portion into the second cavity 28B which surrounds a switching printed circuit board 31 and a metal electronics housing 30. In an embodiment, the fractal member 24 is formed as a copper film that is carried over the substrate 22. In an antenna embodiment, the enclosure 28 may be formed directly over the substrate 22 and its fractal member 24. For example, the space 34 (shown in FIG. 1B) between the substrate 22 and the enclosure 28 may be filled with a urethane foam. The dielectric of the foam can be selected to substantially match that of air so that antenna performance is not altered. In this embodiment, holes 27 in the substrate insure that the substrate 22, fractal member 24, and enclosure 28 are firmly integrated into a one-piece assembly. A center pin of the fitting 25 electrically communicates through an RF portion of the switching board 31 to an RF coaxial connector 36.

In greater detail, FIG. 2A shows that the housing 30 supports the switching board 31 and encloses a logic printed circuit board 32. In particular, the housing electrically and magnetically isolates the logic board 32 (and its electronics such as a microprocessor) away from the switching board 31. These boards are interconnected by a multi-pin connector 33 which passes through the top of the housing 30 to carry various switching commands (e.g., PIN diode commands) and tuning commands. A multi-pin logic command connector 35 is mounted to the bottom of the housing 30 to couple control signals to the logic board 32 from an external source such as a transceiver (e.g., the transceiver 61 in FIG. 6). The RF coaxial connector 36 (e.g., a TNC connector) is mounted to the lower surface of the enclosure 30 and this connector couples RF signals through the RF portion of the switching board 31 to the fitting 25.

A chain 40 of air-core coils 41 are shown in FIG. 2A and again in FIG. 2B which is a view along the plane 2B-2B in FIG. 2A. As shown in views A and B of FIG. 2B, the air-core coils are realized with wound wire and are spaced from the switching board 31 so that magnetic flux is well spaced from the board's printed circuitry to thereby eliminate eddy current losses and thus significantly improve radiation efficiency. The air-core coils are also orthogonally oriented to reduce electromagnetic coupling between coils. Operational use of the air-core coils of the chain 40 will be subsequently described with reference to FIG. 8.

With its aerodynamically-shaped top load 26 and enclosure 30, the antenna system 20 of FIGS. 1A and 1B is particularly suited for mounting over the electrically-conductive outer skin 42 of a high-speed aircraft wherein the skin also serves as a ground plane for the antenna system. The top load 26, substrate 22 and fractal member 24 are shown again in FIG. 3 which also notes that particular portions of the fractal member are especially suited for ultrabroadband antenna operation in different respective antenna bands (e.g., bands I, II, III, IV and V). In addition, FIG. 4 is arranged to compare current distribution in the antenna of FIGS. 1A and 1B to current distribution in a conventional monopole antenna.

Further description of the antenna structures of FIGS. 1A and 1B is deferred at this point to direct attention to significant advantages of the monopole structures in the antenna system 20. It is initially noted that, conceptually, a monopole antenna can be formed by replacing one half of a dipole antenna with a ground plane that is oriented substantially orthogonally with the remaining half. If the ground plane is sufficiently extensive, a monopole antenna operates as if its reflection in the ground plane forms the missing dipole half. In a similar manner, the monopole antenna system 20 of FIGS. 1A and 1B operates above the electrical ground of the aircraft skin 42.

In a benign environment, the physical length of a monopole antenna is preferably set to $\lambda/4$ wherein $\lambda$ is the antenna's operational wavelength. When a monopole structure is mounted on a high-speed aircraft, however, the antenna length is generally significantly shortened and a dielectric antenna enclosure is configured as a aerodynamic blade so that the antenna can structurally survive the aircraft's harsh operational parameters (e.g., vibration and wind pressure). The shortened aerodynamic enclosure also reduces the antenna's effect on the aircraft's performance.

In particular, a monopole antenna is said to be a short antenna if its physical length is less than something on the order of $\lambda/8$. Because its length is less than the ideal monopole length, a short antenna's efficiency is generally reduced because a substantial portion of its transmitting and receiving powers are lost in heating associated ohmic resistances (e.g., resistances in an impedance matching circuit). As shown below, however, the antenna structures of FIGS. 1A and 1B are particularly effective in enhancing the antenna's radiation efficiency.

The radiation efficiency of a monopole antenna is given by $$\eta(\text{dB}) = 10\log\left[\frac{R_A}{R_A + R_{loss}}\right] \tag{1}$$

in which $R_A$ is the radiation resistance of the antenna and $R_{loss}$ is the total loss resistance. The radiation resistance $R_A$ of a monopole antenna is related to current distribution along the antenna's z axis (43 in FIG. 1). In particular, a monopole antenna's current moment M is defined as $$M=\int_O^L I(z)dz \tag{2}$$

in which I(z) is the current distribution along the monopole axis. The radiation resistance is then found by $$R_A=kM^2=k\left[\int_O^L I(z)dz\right]^2 \tag{3}$$

wherein the constant k is defined as $k=80(\pi/\lambda)^2$.

In conventional monopole antennas, the current distribution slowly increases along the antenna length L as shown by the current plot 51 in the graph 50 of FIG. 4 and the radiation resistance is substantially related to the square of the length L. As mentioned above, the length of the antenna system 20 of FIGS. 1A and 1B is significantly shortened to enable the antenna to operate in an aircraft environment and to reduce its effect on aircraft performance. For example, the physical length of the antenna system 20 is preferably in the range of $\lambda_L/40$ to $\lambda_L/50$ wherein $\lambda_L$ is the wavelength at the lowest operating frequency. In an embodiment in which the lowest operating frequency is 30 MHz, the system 20 of FIGS. 1A and 1B only extends approximately 9.5" from the aircraft skin 42.

If restricted to these physical limitations, a conventional monopole antenna would have an extremely low radiation resistance $R_A$ and, therefore, an extremely low radiation efficiency $\eta$. In contrast, the antenna 20 system of FIGS. 1A and 1B combines significant current contributions of the top load 26 and the fractal member 24. The top load is not only aerodynamically shaped for aircraft operation but its length and diameter are chosen to provide a capacitance which functions to electrically lengthen the antenna and significantly increase current distribution at the antenna's upper end as shown in the upper portion of the current plot 53 of the graph 52 of FIG. 4.

Figure 3:
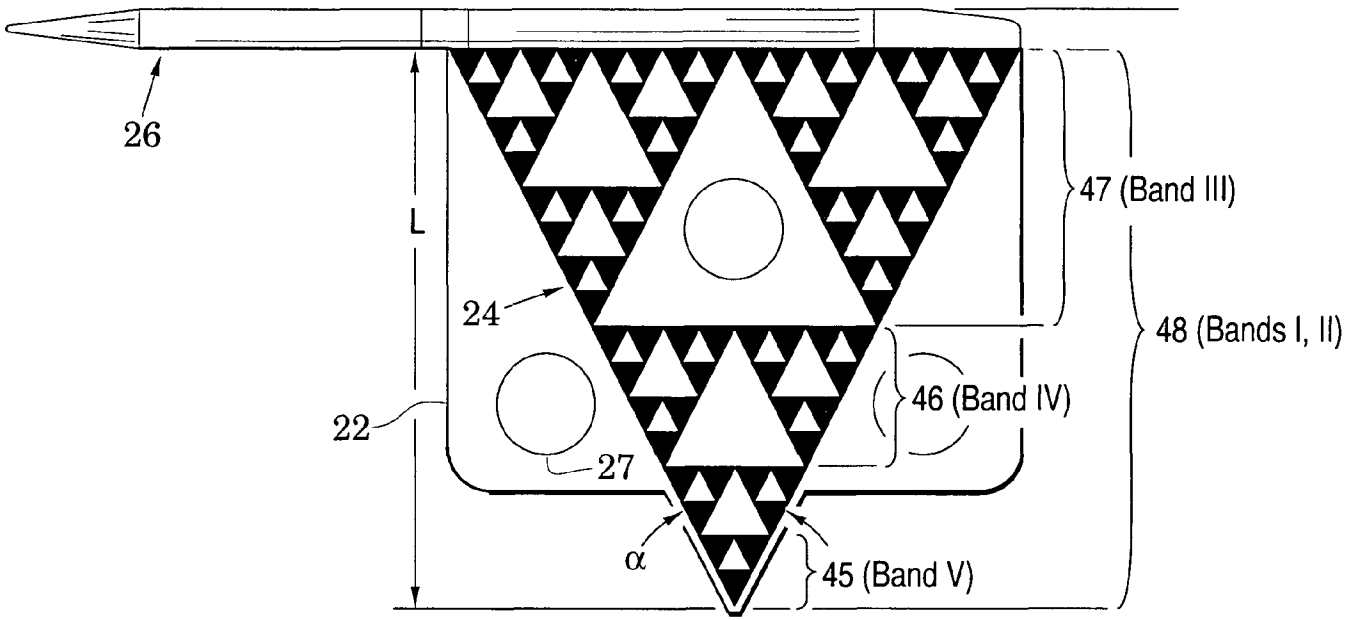
FIG. 3 illustrates exemplary regions in the top load and fractal monopole structure of FIGS. 1A and 1B that may correspond to different operational frequency bands.
Figure 4:
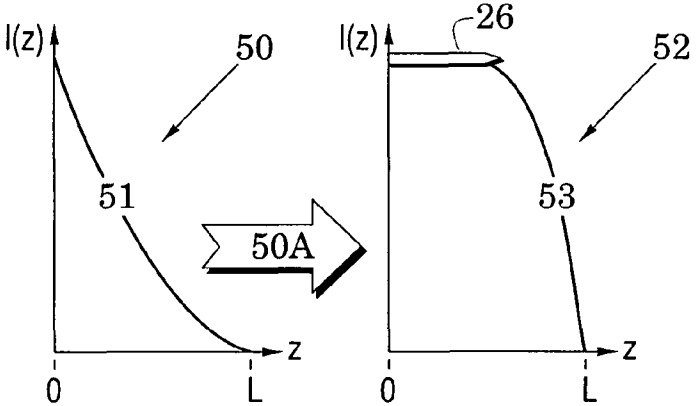
FIG. 4 is a graph that compares current distribution in the antenna structure of FIG. 3 to current distribution in conventional monopole antennas.

As further shown in FIG. 3, the fractal member 24 defines an apex 44 at its lower end. From this apex, the member flares upward with a flare angle $\alpha$ and a length L to terminate at its upper end where it electrically communicates with the top load 26. In general, the fractal member 26 is configured to be symmetric about the apex 44 and to be self-similar which means it has substantially the same appearance in different operational frequency bands. This self-similar quality facilitates a substantially-uniform current distribution along the antenna length L as shown in the plot 53 of FIG. 4.

Thus, current distribution is significantly enhanced at the upper end of the antenna by the presence of the top load and current distribution is enhanced along the remainder of the monopole length by the self-similar nature of the fractal member. As emphasized by an improvement arrow 50A in FIG. 4, integrated current area under the plot 53 has been significantly increased over the current area under the plot 51 and, accordingly, the radiation resistance $R_A$ of equation (3) and the radiation efficiency $\eta$ of equation (1) are substantially enhanced.

Various fractal member embodiments can be used with the top load to enhance the radiation efficiency. The particular embodiment shown in FIG. 3 is generally known as a Sierpinski triangle. In this embodiment, the conductive film that forms the fractal member (over the dielectric 22) defines a plurality of basic conductive elements of constant size—in this embodiment, they are conductive triangles. The apexes of these conductive triangles all point downward—that is, they are directed towards the apex 44 of the fractal member 24. These conductive triangles are arranged in rows to define, between them, triangular voids (absences of conductive film) of varying sizes. Accordingly, the apexes of the triangular voids are directed oppositely to those of the conductive triangles.

As seen in FIG. 3, the lowest three conductive triangles form a fractal sub-pattern 45 which is repeated over the entire fractal member 24 to form a total of twenty seven sub-patterns. These fractal sub-patterns are especially suited for processing (i.e., receiving and transmitting) signals in a highest-frequency band V. As also shown in FIG. 3, three of the sub-patterns 45 combine to form a sub-pattern 46 which is repeated over the entire fractal member 24 to form a total of nine sub-patterns. These fractal sub-patterns are especially suited for processing signals in a frequency band IV that is lower in frequency than the frequency band V.

As further shown in FIG. 3, three of the sub-patterns 46 combine to form a sub-pattern 47 which is repeated over the entire fractal member 24 to form a total of three sub-patterns. These fractal sub-patterns are especially suited for processing signals in a frequency band III that is lower in frequency than the frequency band IV. Finally, three of the sub-patterns 47 combine to form a pattern 48. The pattern 48 and the top load 26 are especially suited for processing signals in frequency bands I and II which are both lower in frequency than band III. It is important to note that other useful fractal member embodiments can be formed by replacing the conductive triangles with other basic conductive elements (e.g., other conductive polygons).

Figure 5A:
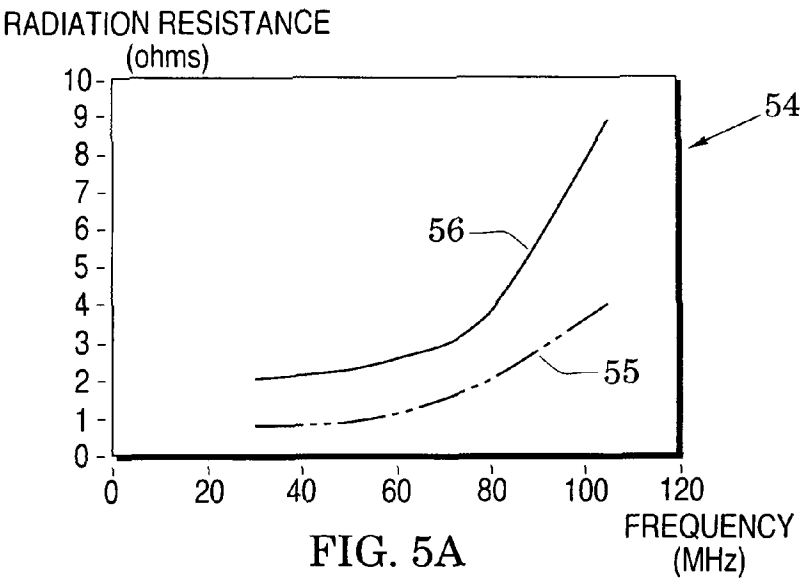
FIGS. 5A and 5B respectively illustrate improved radiation resistance and antenna gain in the system of FIGS. 1A and 1B.
Figure 5B:
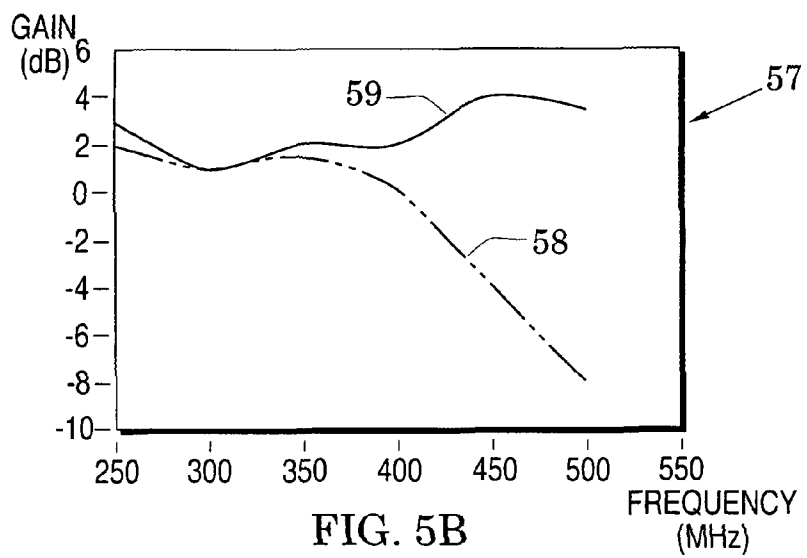

The antenna structure of FIG. 3 measurably enhances antenna performance. For example, the plot 55 of graph 54 of FIG. 5A illustrates radiation resistance over an exemplary frequency band (approximately 30 to 105 MHz) for a conventional monopole antenna. In contrast, the plot 56 illustrates a significantly-increased radiation resistance of the antenna structure of FIG. 3 over the same band. Because the radiation efficiency is enhanced by the combination of a top load and a fractal member, antenna gain is also enhanced. For example, the plot 58 of graph 57 of FIG. 5B illustrates gain over another exemplary frequency band (approximately 250-500 MHz) for a conventional monopole antenna. Again in contrast, the plot 59 illustrates that the gain of the antenna structure of FIG. 3 is significantly increased in the upper portions of this band. When compared to conventional monopole structures of comparable height, it has thus been found that the fractal member 24 and associated top load 26 improves signal gain especially in upper frequency bands (e.g., above 400 MHz) and lower frequency bands (e.g., between 30 and 88 MHz).

Figure 6:
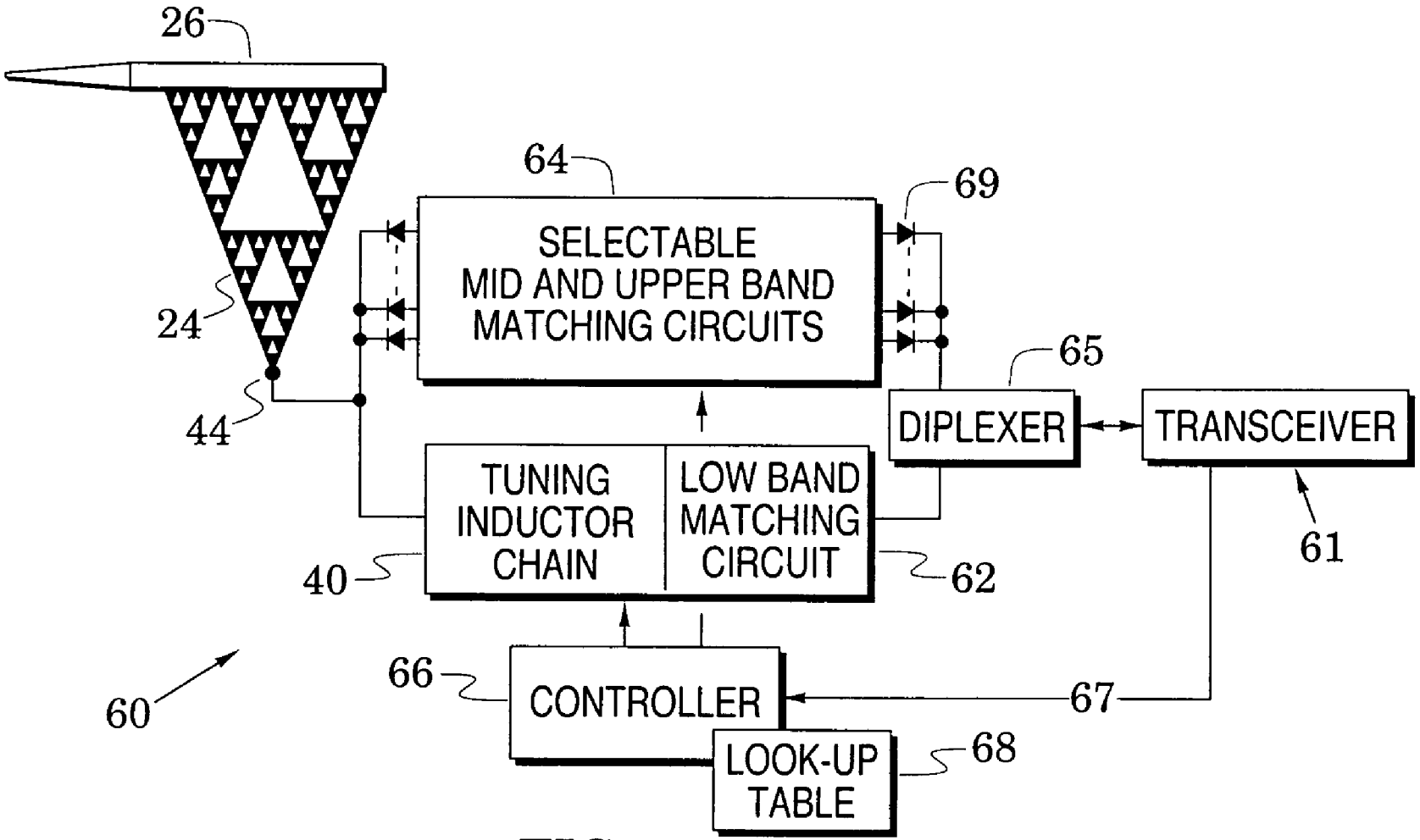
FIG. 6 is a block diagram that illustrates additional structures in the system of FIGS. 1A and 1B.
Figure 10:
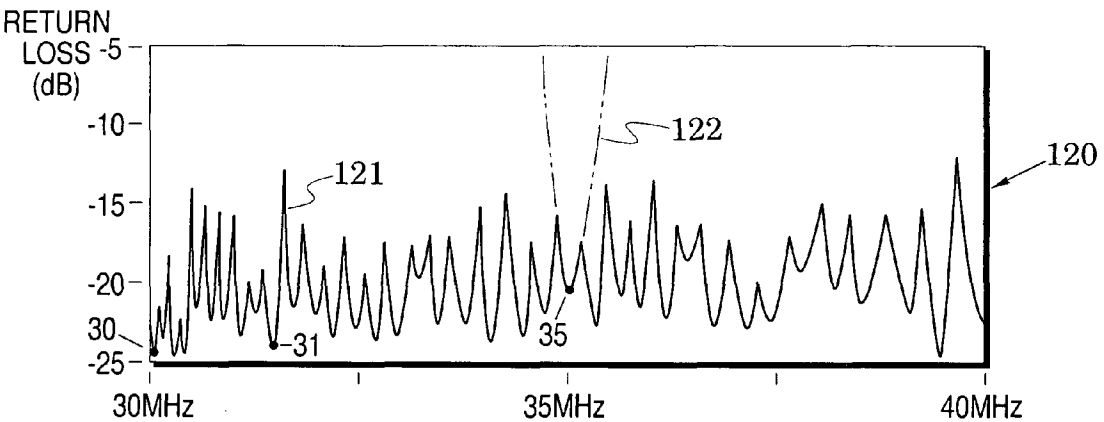
FIG. 10 illustrates return loss realized with the system of FIG. 8 in a selected portion of the lowest frequency band of FIG. 7A.

The enhanced radiation efficiency and gain of the system 20 can be advantageously applied to a variety of airborne applications. For example, FIG. 6 shows that a system embodiment 60 can be used to effectively interface with a transceiver 61 via added system structures of a low-band matching circuit 62, the selectable inductor chain 40, and selectable mid and upper band matching circuits 64 that are all coupled between the antenna apex 44 and the transceiver 60 with the aid of a diplexer 65. Selection of the mid and upper band matching circuits and of inductors of the inductor chain 40 is realized with a controller 66 which receives commands 67 from the transceiver and which may be augmented by a memory (e.g., a look-up table 68). The controller 66 may be realized with conventional electronics (e.g., a gate array or an appropriately-programmed microcontroller) and selections of the controller may be facilitated with controlled switching elements such as PIN diodes 69. Processes of a controller embodiment are shown in FIG. 10.

Figures 7A, 7B:
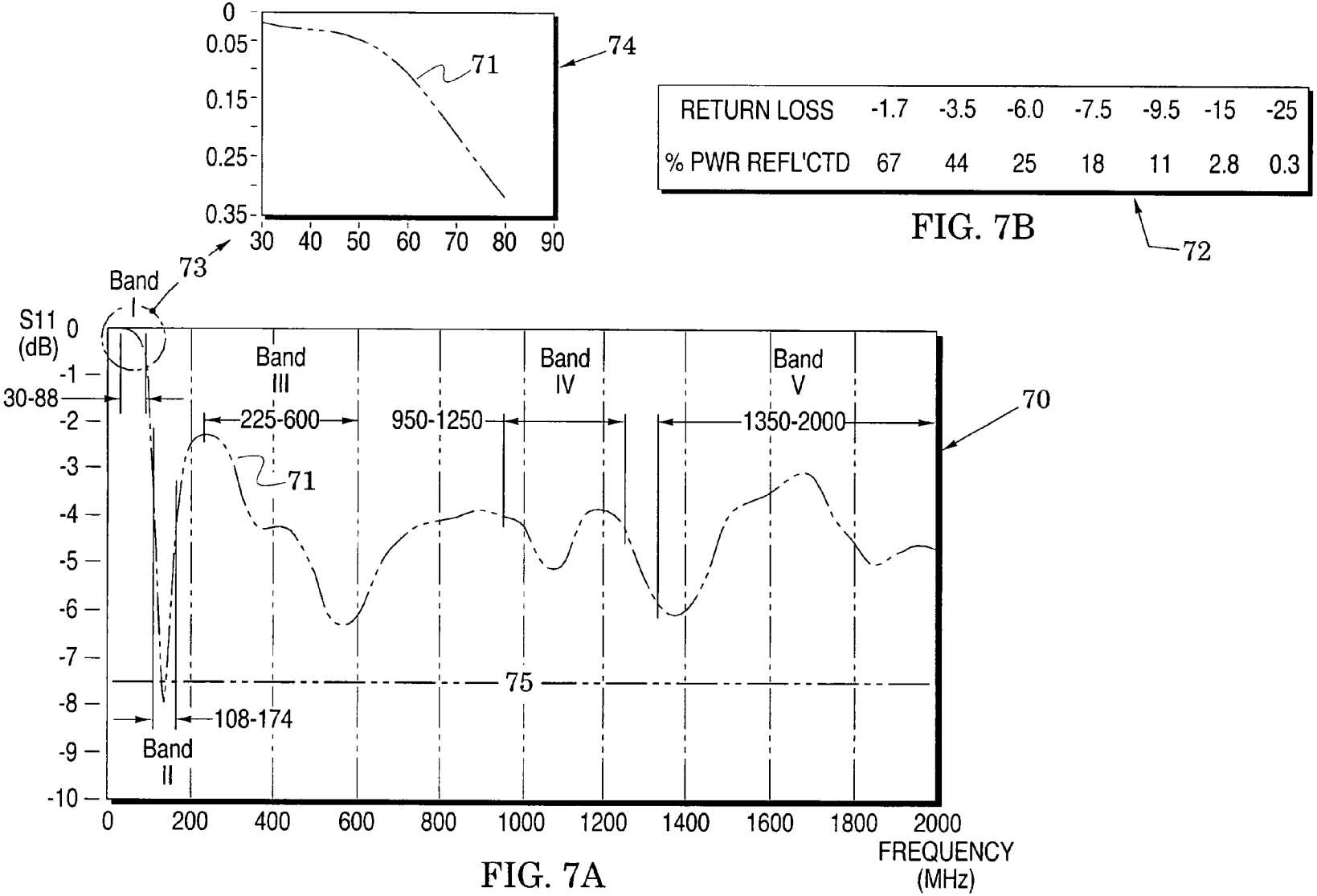
FIG. 7A is a graph of return losses at an antenna apex in the system of FIG. 6 over different frequency bands.
FIG. 7B is a plot that relates return loss to percentage of reflected power.

Although the fractal member 24 and top load 26 substantially enhance the system's radiation resistance and gain, they alone cannot provide acceptable return loss performance across an ultrabroadband range. The graph 70 of FIG. 7A, for example, illustrates a broken-line plot 71 which represents return loss at the fractal member apex 44 of FIG. 6 for the exemplary frequency bands I, II, III, IV and V that were introduced in FIG. 3. As shown, these frequency bands cover most of the frequency span below 2000 MHz and, over most of this ultrabroadband range, the return loss varies from a bit less than −2 dB to a bit more than −6 dB. The conversion table 72 of FIG. 7B indicates that this means that more than 25% of incident power is being reflected at the fractal member apex 44. FIG. 7A also shows that return loss improves in frequency band II but substantially degrades in frequency band I which, as indicated by an arrow 73, is shown again in an enlarged graph 74.

Although improvement of this return loss can be realized by varying parameters of the fractal member 24 (e.g., the substrate dielectric, the flare angle $\alpha$ and the length L) and by varying parameters of the top load 26 (e.g., its diameter and length), it is dramatically improved to lie below the broken line 75 in FIG. 7A when the low-band matching circuit 62, the tuning inductor chain 40, and selectable mid and upper band matching circuits 64 of FIG. 6 are inserted between the fractal member apex 44 and an exemplary transceiver 61.

Figure 8:
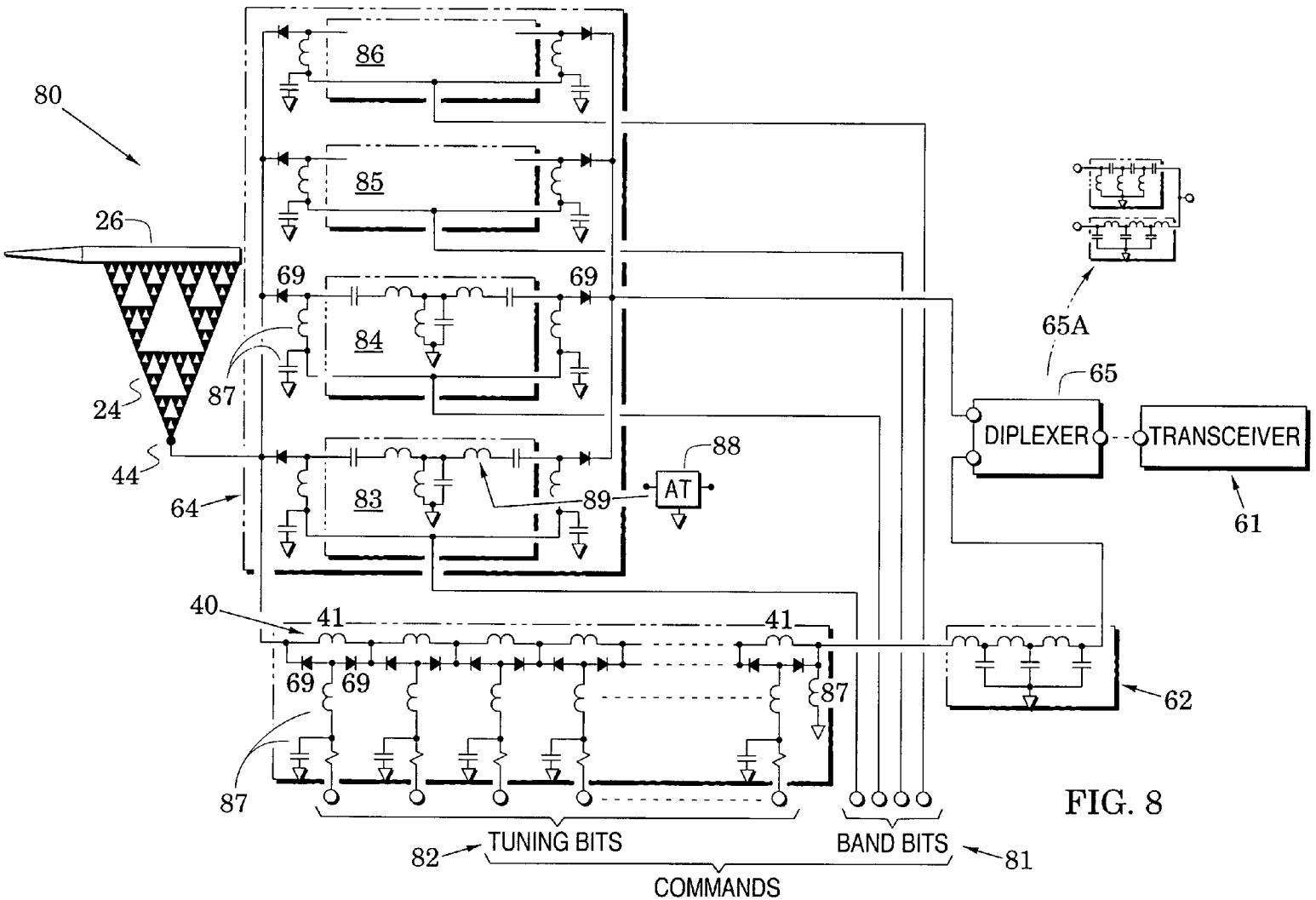
FIG. 8 illustrates a detailed embodiment of portions of FIG. 6.

This is illustrated with aid of FIG. 8 which illustrates an antenna system embodiment 80 that includes elements of the system 60 of FIG. 6 with like elements indicated by like reference numbers. FIG. 8 shows detailed embodiments of the tuning inductor chain 40, the low band matching circuit 62, and the selectable mid and upper band matching circuits 64 (an arrow 65A in FIG. 8 also shows that the diplexer 65 can be realized with high-pass and low-pass circuits).

In particular, the matching circuits 64 includes impedance-matching circuits 83, 84, 85 and 86 which may each be selected with diodes 69 that are switched on and off by band bits 81 of commands issued by the controller (66 in FIG. 6). Impedance-matching circuit 83, for example, is switched between the antenna apex 44 and the transceiver 61 to process signals in the frequency band II of FIG. 7A. Impedance-matching circuit 84 is switched between the antenna apex 44 and the transceiver to process signals in frequency band III and impedance-matching circuit 85 is switched between the antenna apex 44 and the transceiver to process signals in frequency band IV. Finally, impedance-matching circuit 86 is switched between the antenna apex 44 and the transceiver to process signals in frequency band V.

Functioning of the system 80 may be exemplified by directing attention initially to the impedance-matching circuit 84. This circuit is switched into the system with a respective one of band bits 81 (part of the commands at the command connector 35 in FIG. 2A) which turns on diodes 69 that are adjacent the circuit. Isolation elements 87 (e.g., shunt capacitor and series inductor) at each end of the circuit 83 isolate it from the band command lines. The elements shown in the impedance-matching circuit 84 are for exemplary purposes as they are intended to illustrate that these circuits may comprise various combinations of series reactance elements (capacitors and inductors) and shunt susceptance elements (capacitors and inductors).

Figure 9B:
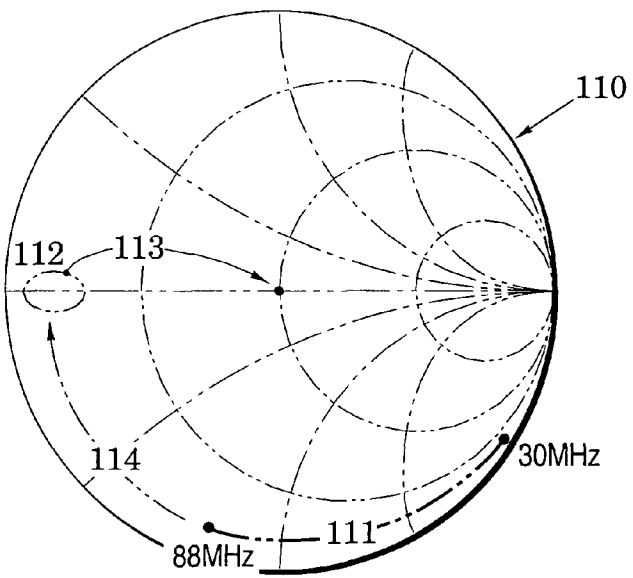
FIG. 9B is a Smith Chart that illustrates exemplary inductance tuning and impedance matching realized with a chain of air-core coils and an impedance-matching circuit of FIG. 8.
Figure 9A:
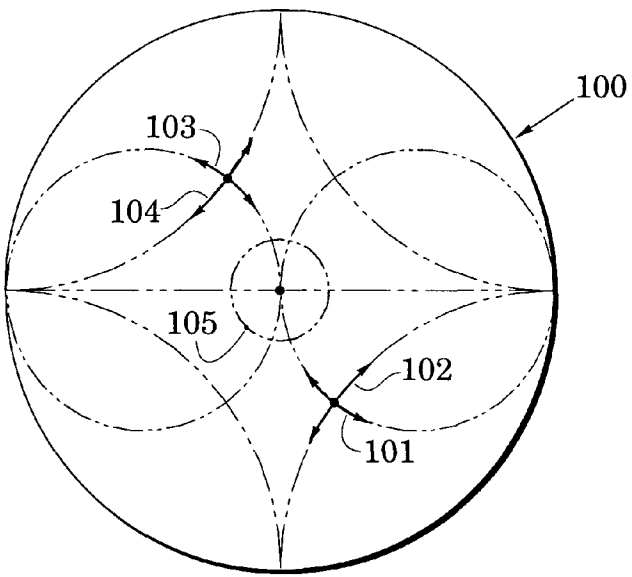
FIG. 9A is a Smith Chart that illustrates exemplary impedance matching realized with selected impedance-matching circuits of FIG. 8.

As shown in the Smith Chart 100 of FIG. 9A, it is known that series reactance elements may move an impedance along an exemplary reactance path 101 and that resistance series elements may move it along an exemplary resistance path 102. Similarly, it is known that shunt susceptance elements may move an impedance along an exemplary susceptance path 103 and that admittance shunt elements may move it along an exemplary admittance path 104. It is apparent, therefore, that series and shunt elements such as those exemplified in the impedance-matching circuit 84 can be arranged to convert the impedance at the antenna apex 44 to lie within a region 105 that is sufficiently close to the 50 ohm center of the Smith Chart to significantly improve the impedance match with the transceiver 61.

By dedicating the impedance-matching circuit 84 to operations in the frequency band III from 225 MHz to 600 MHz, the measured return loss in this frequency band has, in fact, been reduced to lie below the broken line 75 in FIG. 7A. As shown in the table 72 of FIG. 7B, this means that the reflected power has been reduced to less than 18% in frequency band III.

In a similar manner, the impedance-matching circuits 85 and 86 are respectively dedicated (via band bits 81 and switching diodes 69) to operations in frequency bands IV (950-1250 MHz) and V (1350-2000 MHz). With circuits such as those discussed above with reference to impedance-matching circuit 84, the measured return loss in these frequency bands has also been reduced to lie below the broken line 75 in FIG. 7A so that reflected power has been reduced to less than 18% in frequency bands IV and V.

In some impedance-matching embodiments, it may be advantageous to include an attenuator 88 as indicated by the exchange arrow 89 in FIG. 8. Use of an attenuator in the impedance-matching circuit 83 will reduce overall gain but can substantially improve return loss over the 108-174 MHz range of frequency band II. For example, a 4 dB attenuator may improve the return loss in this band to something on the order of −8 dB (i.e., below the broken line 75) because reflections cause signals to pass twice through the attenuator. This attenuation may also reduce overall gain by 4 dB but, because the gain is reasonably high in this band, this is a reasonable compromise.

Attention is now directed to use of the tuning inductor chain 40 and the low band matching circuit 62 of FIG. 8 when the system 80 is operated in the 30-88 MHz range of frequency band I in FIG. 7A. First, it is noted that measurements of the impedance of the fractal member apex (44 in FIG. 8) in the 30-88 MHz range have shown that it lies on the locus 111 shown in the Smith Chart 110 of FIG. 9B. Thus, the apex impedance has a low resistive component across frequency band I but its capacitive component successively increases as the frequency decreases from 88 MHz to 30 MHz.

It has been realized, therefore, that inductive elements (e.g., the air-core coils of FIG. 8) can be used (as exemplified by the reactance path 101 of FIG. 9A) to successively transform respective portions of the locus 111 to a low-resistance and substantially zero reactance region 112 that lies about the real line of the Smith Chart 110 of FIG. 9B. Impedance presence in the region 112 implies antenna resonance at specific frequencies throughout frequency band I. Once this resonance has been realized, the low band matching circuit 62 can be configured (in ways similar to those described above with respect to frequency bands II through V) to convert the low resistance of the region 112 to the 50 ohm region as indicated by conversion arrow 113.

Accordingly, in FIG. 8 the air-core coils 41 of FIG. 2A are arranged in a chain 40 between the fractal member apex 44 and the impedance-matching circuit 62 so that they can be selected to convert frequency points along the locus 111 in FIG. 9B to the region 112. A pair of diodes 69 are arranged about each coil and each of these pairs can be driven by a respective tuning bit that is provided by the controller 66 in response to commands from the transceiver 61.

Each coil can thus be selected to be an operational part of the chain (by back biasing its diodes) or removed from the chain (by forward biasing the diodes). PIN diode driver elements on the logic board (32 in FIG. 2A) respond to tuning bit commands from the controller 66 and appropriately switch the diodes 69 which can be carried on the switching board (31 in FIG. 2A). Isolation elements 87 are provided to isolate the coils from the tuning bit lines. Another isolation element 87 is provided at the end of the chain to route DC current back to ground (see FIG. 8).

The tuning bits may, for example, retain only the smallest of the coils 41 in the chain when the transceiver is operating at 88 MHz because the resulting inductance is sufficient to tune out the capacitance at the 88 MHz end of the locus 111 of FIG. 9B to the low-resistance region 112. At this time, the remaining coils would be shorted out by their respective diodes.

The number of coils 41 retained in the chain 40 then increases as the operational frequency decreases and the operating point moves along the locus 111. When the operating frequency has reduced to 31 MHz, for example, all of the coils 41 except one may be needed to provide sufficient inductance. When the operating point is at the far end of the locus 111 (i.e., an operating frequency of 30 MHz), the tuning bits are set so that all of the coils 41 are in series with the impedance-matching circuit 62. This maximum inductance (formed by all of the coils 41) is designed to tune out the maximum capacitance at the 30 MHz end of the locus 111.

The plot 121 in the graph 120 of FIG. 10 illustrates the measured return loss that is achieved between 30 and 40 MHz of the frequency band I when the coils of the tuning chain are appropriately selected. As examples, dots indicate return loss for the specific operational frequencies of 30, 31 and 35 MHz. Because these return losses are greater than −20 dB, the table 72 of FIG. 7B indicates that less than 0.3% of incident power is now reflected. It is informative to compare these return losses to the return losses for these same operational frequencies of 30, 31 and 35 MHz at the apex 44 in FIG. 6. As shown in the enlarged graph 74 of FIG. 7A, these latter return losses are substantially less than −0.25 dB which implies nearly complete reflection of RF. It is apparent, therefore, that insertion of the tuning inductor chain 40 and associated impedance-matching circuit 62 dramatically improves system performance.

It should be understood that points on the plot 121 represent return loss results as the chain of coils 40 is tuned for each operating frequency. When the operating frequency is 35 MHz, for example, the other portions of the plot 121 would be much higher indicating that return loss at other frequencies is considerably degraded for this particular selection of coils. This is indicated by continuation lines 122 which show that, with this particular coil selection, the return loss would rapidly degrade away from the operational frequency of 35 MHz. In other words, the selectivity of the system 80 of FIG. 8 is very high when operating in frequency band I so that the percentage of reflected power is quite low at the selected frequency and significantly higher elsewhere.

It has been found useful to employ the selectable coils 40 of the chain even when operating in bands other than the low-frequency band I. It is apparent from FIG. 8, that these coils are in series with the matching circuit 62 but are essentially in shunt with other matching circuits such as the matching circuit 84. As mentioned above, this latter circuit is used when the system 80 is operating in band III. It can be seen from FIG. 7A that this band has an unusually large ratio of approximately 2.7 when the maximum band frequency of 600 MHz is divided the minimum band frequency of 225 MHz.

For example, it has been found useful to use the tuning bits 82 to obtain a shunt inductance that is realized with a selected three of the coils 41 when operating in the 225-350 MHz portion of band III. This shunt inductance can be used to enhance the impedance match in this band portion while, in other portions of band III, the tuning bits are set so that all of the selectable inductors are in the circuit. The sum of all of the inductors forms a blocking inductor at these frequencies so that operation of the matching circuit 84 is undisturbed in these band portions.

The system 80 is thus configured with the capability to efficiently process transmission and reception signals over an ultrabroadband range (e.g., 30 to 20000 MHz). This capability supports the JTRS system in general and enhances use of the system 80 in particular communication systems such as Single Channel Ground-to-Air Radio System (SINCGAR), Land Mobile Radio (LMR), Enhanced Position Location and Reporting System (EPLRS), Tactical Data Link (TDIL), and Digital Wideband Transmission System (DWTS). The system 80 is also compatible with the use of specific signal processes such as frequency hopping and spread spectrum.

To direct all of this capability, the system's controller 66 responds to commands from the transceiver to provide band bits 81 which can select any desired one of the impedance-matching circuits 83, 84, 85 and 86. The system's controller also provides tuning bits 82 which can rapidly select coils 40 from the tuning chain to achieve efficient operation (e.g., a frequency hopping operation) within band I. It is noted that all elements of FIG. 8 (except the transceiver 61) are contained within the antenna structure of FIGS. 1A and 1B so that the complete system is self-contained. It can be mounted on the aircraft skin 42 and operationally connected through only two connectors (the command and RF connectors 35 and 36).

To facilitate efficient low-loss operation in the lowest frequencies of band I, the reactances required from the selectable coils 41 of the chain 40 of FIG. 8 may be substantial. For example, these reactances may vary from 50 to 320 ohms and require inductances that vary from 90 to 1700 nanohenries as the selected channel frequencies decrease from 88 to 30 MHz. The inductor quality factor Q can therefore be as high as 180 which means that the voltage across these inductors can be quite substantial. In addition, some communication systems require extremely rapid switching times (e.g., 32 microseconds) between the channel commands 82 that select the inductors.

If each of these coils were conventionally realized as a printed-circuit spiral 130 on the substrate 131 of a printed-circuit board as exemplified in FIG. 2C, large amounts of magnetic flux would penetrate the substrate and induce eddy currents that significantly raise the loss resistance in equation (1) and degrade radiation efficiency. As shown in FIGS. 2A and 2B, the coils 41 are formed, instead, with wire wound to form air-core coils that are spaced from the switching board. In addition, the coils 41 are arranged to have their axes 132 parallel to the switching board 31 rather than through the switching board as in the case of the spiral 130.

In this novel arrangement, the magnetic flux that passes through the board substrate is significantly reduced so that the loss resistance is reduced which substantially improves antenna gain and radiation efficiency (e.g., by 3-4 dB). In a secondary advantage, heating of the board substrate is substantially reduced which insures the integrity of the switching board 31. When conventional printed-circuit spirals are used for the chain of inductors, it has been found that the resultant substrate heating can severely damage the printed-circuit board. FIGS. 2A and 2B show that the air-core coils are also orthogonally arranged with each other so that only a small portion of the magnetic flux of one coil passes through the neighboring coils to thereby further enhance antenna gain and return loss.

Figure 11:
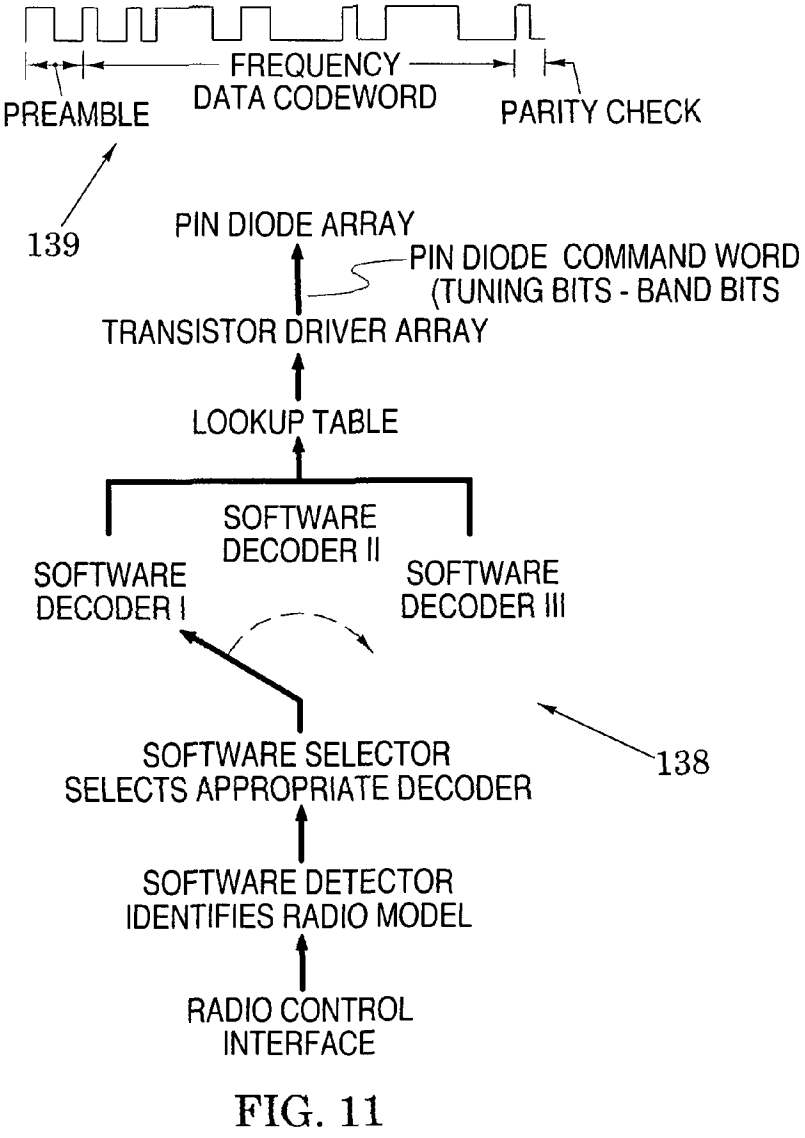
FIG. 11 is a flow chart that illustrates control processes in an embodiment of a controller of FIG. 6 which provides the commands shown in FIG. 8.

FIG. 11 illustrates a flow chart 138 which provides antenna process embodiments that can be programmed into and carried out by the controller 66 (and associated look-up table 68) of FIG. 6. As indicated in the flow chart, control commands can come from a variety of radio models. The controller is configured to identify the radio model based on various inputs (e.g., pin functions and/or signal features associated with the multi-pin logic command connector 35 of FIG. 2A).

Because different coding formats (e.g., binary, binary to decimal, and Manchester) may be used by different message sources, various decoding softwares are provided to convert the codeword to the frequency message. Accordingly, identification of the radio model facilitates the selection of an appropriate decoder software. For exemplary purposes, the software selector is configured in FIG. 11 to select among three possibly different software decoders (as indicated by broken-line arrow in FIG. 11). Although the control signal word format and protocol may differ depending on which radio manufacture originates it, the format of each model is generally organized via the combination of a preamble, data codeword and parity check as shown in the exemplary codeword format 139 in FIG. 11.

Once the incoming frequency commands are decoded, appropriate locations in a lookup table (e.g., an electrically erasable programmable read-only memory (EEPROM)) are accessed to thereby provide appropriate command signals to an array of transistor drivers which can generate the currents required to drive the indicated PIN diodes of the PIN diode array (e.g., the selected ones of the diodes 69 shown in FIG. 8) and thereby select frequency bands (e.g., band III) and/or select among the chain 40 of air-core coils 41. Although the PIN diodes are preferably located on the switching board 31 in FIG. 2A, the remaining controller components (e.g., appropriately-programmed microprocessor, lookup table, transistor drivers) are preferably carried on the logic board 32 in the electronic housing 30 so that their control signals are isolated and do not feed onto antenna signal pathways (e.g., paths coupled to the apex 44 in FIG. 6).

Figure 12:
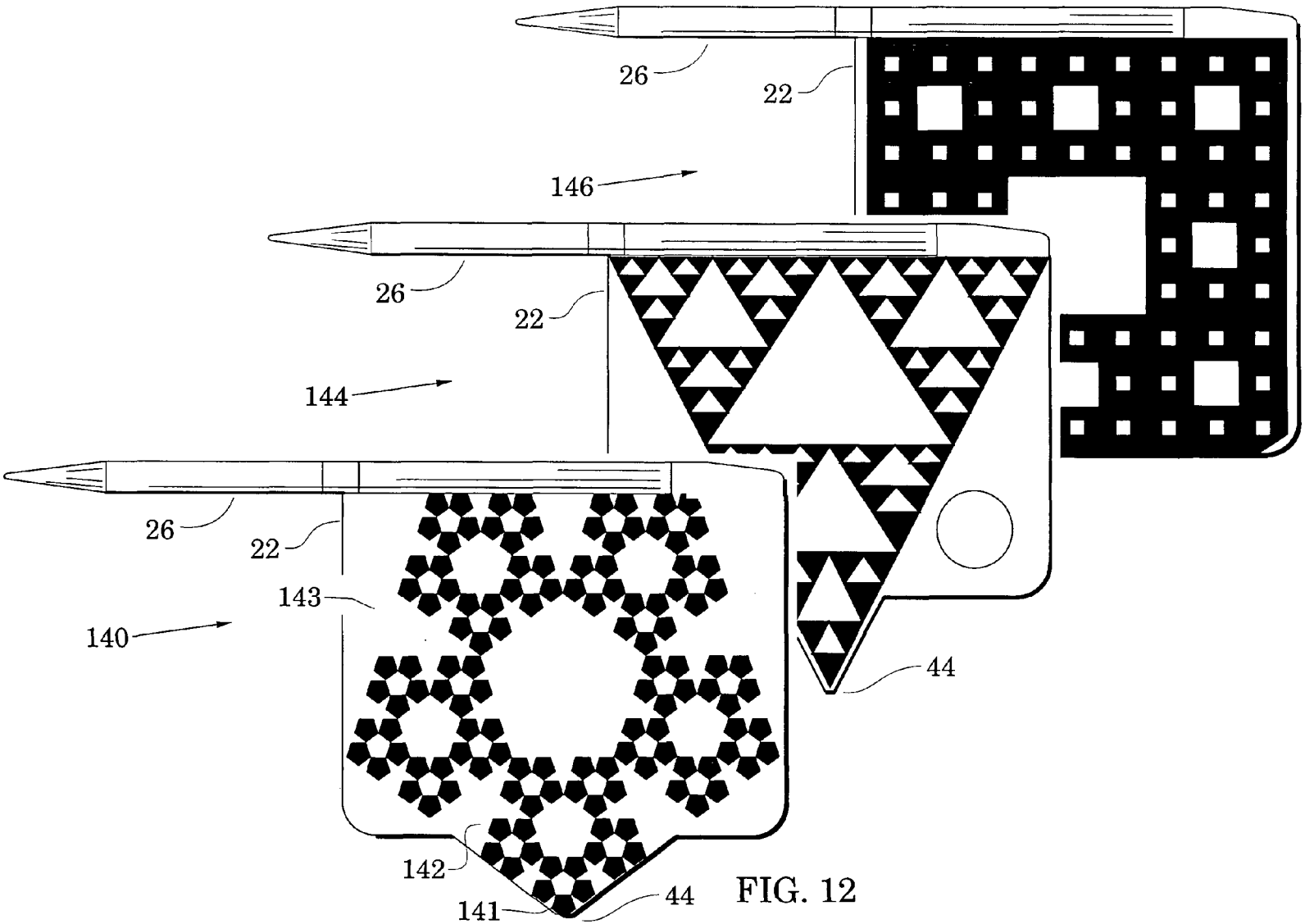
FIG. 12 illustrates other embodiments of the fractal member shown in FIG. 3.

A Sierpinski triangle has been shown as a fractal member embodiment in FIGS. 1A, 2A, 3, 6 and 8 to illustrate system embodiments. In addition, FIG. 12 illustrates examples of other fractal member embodiments which are each shown in association with a substrate 22 and a top load 26. For example, an embodiment 140 begins with a polygon 141 (in particular, a pentagon) at the apex 44. The polygon is repeated to form a polygonal ring of polygons. The polygonal ring is then repeated to form larger rings 142 which are repeated again to form a final single ring 143 that abuts the top load 26.

The fractal member of the embodiment 144 is similar to the embodiment 24 in FIG. 2 except that repeated elements are not self-similar. For example, the conductive triangles vary in size so that the open triangles also vary in size. Finally, an embodiment 146 is formed with conductive squares (or rectangles) which are arranged in rows to define square voids of varying sizes. This particular embodiment is generally known as a Sierpinski carpet.

Top-loaded, fractal tunable antenna system embodiments have been described which are compact and aerodynamic for aircraft operation and are self-contained for easy installation in the field. They are capable of efficient multi-band operation over an ultrabroadband range. The embodiments can achieve high gain, excellent tuning selectivity, fast channel switching times and are power efficient. The combination of a top load and a fractal member enhances current distribution in the lower portions of the ultrabroadband range and particularly enhances gain in the higher portions. Novel arrangements of air-core coils in low-band tuning circuits significantly improve radiation efficiency, return loss and gain and insures that heat generation will not damage system elements nor endanger aircraft safety.

As noted above, self-contained system embodiments are configured to respond to control commands and comprise a conductive fractal member that extends from a first end to a second end, a top load coupled to the second end, a set of impedance-matching circuits each configured to substantially match a first end impedance to a predetermined system impedance over a respective one of a set of predetermined frequency bands, and a controller configured to couple any selected one of the circuits to the first end in response to the control commands. As previously described, at least one of the circuits may include a chain of selectable air-core coils wherein the air-core coils are orthogonally arranged.

The controller is further configured to determine an identified source of the control commands, and, in accordance with predetermined encoding rules of the identified source, decode the control commands to obtain decoded control commands. The controller preferably includes a set of switching diodes arranged to couple respective ones of the circuits to the first end and the controller is configured to turn on selected diodes of the set in response to the decoded control commands. In an embodiment, the controller includes transistor drivers connected to provide switching currents to the diodes in response to the decoded control commands. In another embodiment, the controller includes a lookup table that identifies the selected diodes in response to the decoded control commands.

As described above, the top load is configured to define an aerodynamic shape and an aerodynamically-shaped dielectric enclosure is coupled to the top load and arranged to protectively surround the fractal member, the impedance-matching circuits and the controller so that the top load and the enclosure form a self-contained aerodynamic antenna system.

The embodiments of the invention described herein are exemplary and numerous modifications, variations and rearrangements can be readily envisioned to achieve substantially equivalent results, all of which are intended to be embraced within the spirit and scope of the appended claims.

We claim:

1. An antenna system, comprising:

a conductive fractal member that extends from a first end to a second end and is configured to define an apex at said first end;

a top load having an aerodynamic shape and coupled to said second end; and an aerodynamically-shaped dielectric blade arranged to surround said fractal member.

2. The system of claim 1, wherein said fractal member is configured to be substantially symmetric about said apex and to define a pattern having self-similar elements.

3. The system of claim 2, wherein said fractal member is configured to define a Sierpinski triangle.

4. The system of claim 1, wherein:

said top load has a diameter and a length sufficient to present a selected capacitance to said fractal member; and said blade comprises fiberglass.

5. The system of claim 1, further including a set of impedance-matching circuits each selectively coupled to said first end and configured to substantially match an antenna impedance to a predetermined system impedance over a respective one of a set of predetermined frequency bands.

6. The system of claim 1, further including:

a first impedance-matching circuit coupled to said first end and configured to substantially match an antenna impedance to a predetermined system impedance over a predetermined first frequency band; and a set of impedance-matching circuits each selectively coupled to said first end and configured to substantially match an antenna impedance to a predetermined system impedance over a respective one of a set of predetermined additional frequency bands.

7. The system of claim 6, wherein said first impedance-matching circuit includes a chain of selectable air-core coils to enhance said match over said first frequency band.

8. The system of claim 6, wherein said air-core coils are orthogonally arranged.

9. The system of claim 6, wherein said first impedance-matching circuit is configured to process signals having a maximum wavelength $\lambda_{max}$ and said fractal member is configured with a length between said first and second ends that does not exceed $\lambda_{max}/40$.

10. The antenna of claim 1, further including a dielectric sheet and wherein said fractal member comprises a copper film on said sheet.

11. An antenna system, comprising:

a conductive member that extends from a first end to a second end;

a top load coupled to add capacitance to said second end; and a set of impedance-matching circuits each configured to substantially match an antenna impedance at said first end to a predetermined system impedance over a respective one of a set of predetermined frequency bands;

wherein one of said circuits includes a chain of selectable air-core coils to enhance said match over at least one of said frequency bands and further including a support substrate wherein at least two of said air-core coils are orthogonally arranged and supported by and spaced from said substrate.

12. The system of claim 11, wherein at least one of said circuits includes reactance and susceptance elements.

13. The system of claim 11, wherein said conductive member is a fractal member and said top load has an aerodynamic shape.

14. The system of claim 11, wherein a lowest-frequency one of said circuits is configured to process signals having a maximum wavelength $\lambda_{max}$ and said fractal member is configured with a length between said first and second ends that does not exceed $\lambda_{max}/40$.

15. The system of claim 11, further including:

a transceiver; and a diplexer coupling said transceiver to said circuits.

16. An antenna system configured to respond to control commands, comprising:

a conductive fractal member that extends from a first end to a second end;

a top load coupled to said second end;

a set of impedance-matching circuits each configured to substantially match a first end impedance to a predetermined system impedance over a respective one of a set of predetermined frequency bands; and a controller configured to couple any selected one of said circuits to said first end in response to said control commands.

17. The system of claim 16, wherein said controller is further configured to:

determine an identified source of said control commands; and in accordance with predetermined encoding rules of said identified source, decode said control commands to obtain decoded control commands.

18. The system of claim 17, wherein said controller includes a set of switching diodes arranged to couple respective ones of said circuits to said first end and said controller is configured to turn on selected diodes of said set in response to said decoded control commands.

19. The system of claim 18, wherein said controller includes transistor drivers connected to provide switching currents to said selected diodes in response to said decoded control commands.

20. The system of claim 18, wherein said controller includes a lookup table that identifies said selected diodes in response to said decoded control commands.

21. The system of claim 16, wherein at least one of said circuits includes a chain of selectable air-core coils.

22. The system of claim 21, wherein said air-core coils are orthogonally arranged.

23. The system of claim 16, wherein said top load is configured to define an aerodynamic shape.

24. The system of claim 23, further including an aerodynamically-shaped dielectric enclosure coupled to said top load and arranged to protectively surround said fractal member, said circuits and said controller so that said top load and said enclosure form a self-contained antenna system.

* * * * *